US005199233A

United States Patent [19]

Fukutomi et al.

[11] Patent Number: 5,199,233

[45] Date of Patent: Apr. 6, 1993

[54] PREFABRICATED CONCRETE BASEMENT AND PROCESS FOR CONSTRUCTING THE SAME

[75] Inventors: Hideo Fukutomi; Hideaki Sagawa; Takashi Minakuchi, all of Tokyo, Japan

[73] Assignee: Misawa Homes Co. Ltd., Tokyo, Japan

[21] Appl. No.: 702,070

[22] Filed: May 17, 1991

[30] Foreign Application Priority Data

May 23, 1990 [JP] Japan ..... 2-133165
Jun. 8, 1990 [JP] Japan ..... 2-150304

[51] Int. Cl.[5] ..... E04H 1/00

[52] U.S. Cl. ..... 52/169.14; 52/79.14; 52/252; 52/236.1; 52/745.02; 52/745.20

[58] Field of Search ..... 52/79.1-79.4, 52/79.9, 79.14, 250-252, 236.1, 236.3, 236.5, 236.6, 134-137, 169.6, 169.5, 169.14, 745

[56] References Cited

U.S. PATENT DOCUMENTS

| | | | |
|---|---|---|---|
| 3,201,907 | 8/1965 | Henderson | 52/79.14 X |
| 3,724,141 | 8/1973 | Kelleher | 52/79.14 X |
| 3,830,025 | 8/1974 | Wainshal | 52/79.14 X |
| 4,006,574 | 2/1977 | van der Lely . | |
| 4,138,833 | 2/1979 | Townend | 52/79.14 X |
| 4,607,467 | 8/1986 | Roux | 52/169.6 |
| 5,081,805 | 1/1992 | Jazzar | 52/79.2 |

FOREIGN PATENT DOCUMENTS

| | | |
|---|---|---|
| 0162758 | 11/1985 | European Pat. Off. . |
| 3829837 | 2/1989 | Fed. Rep. of Germany . |
| 1510032 | 1/1968 | France . |
| 2216405 | 3/1970 | France . |
| 2610349 | 8/1988 | France . |

OTHER PUBLICATIONS

Patent Abstract of Japan, vol. 6, No. 267 (M-182) (1145) Dec. 25, 1982.

*Primary Examiner*—Richard E. Chilcot, Jr.
*Attorney, Agent, or Firm*—Kane, Dalsimer, Sullivan, Kurucz, Levy, Eisele and Richard

[57] ABSTRACT

A concrete prefabricated basement having a number of underground units, each of which includes a bottom plate portion having a generally rectangular shape and a side plate portion, to form a rectangular box-shaped structure with an open top, the number of underground units being arranged side by side in a lateral direction of the underground units, and any adjacent two of the number of underground units being connected to each other, so that each of the underground units comprises a number of precast concrete blocks abutted one to another at parallel planes perpendicular to a longitudinal direction of the underground units, the blocks being integrated with each other by a first connecter, and in which the blocks have a waterproof layer and a protective layer on the waterproof layer over the entire outer surface of the bottom plate portion and side plate portions of the blocks; and a method for constructing such a basement, as well as a house construction with such a basement.

24 Claims, 11 Drawing Sheets

PREFABRICATED CONCRETE BASEMENT AND PROCESS FOR CONSTRUCTING THE SAME

BACKGROUND OF THE INVENTION

1. Field of the Invention

The present invention relates to a prefabricated-type concrete basement suitable as a part of a dwelling, and more particularly, to basements constructed of underground units made of a plurality of precast concrete blocks bound to one another to form a unitary rectangular enclosure. This invention also relates to a process for constructing such basements, and to dwellings with such basements.

2. Prior Art

Due to housing shortages in recent years, and for various other reasons, it has become highly desirable to provide basements or below-ground living spaces in ordinary dwellings.

Heretofore, the basements of houses have often been constructed primarily as underground storage spaces or storehouses, and accordingly, the basements were constructed as enclosures which were fitted in excavations and set in the ground by anchor bolts, and the unoccupied part of the excavations thereafter being filled (cf., e.g., Japanese Patent Application No. Hei-1-15663).

However, the basements of the aforementioned construction, which are constructed so as to be suitable as underground warehouses, enclosed relatively small interior spaces and therefore failed to provide sufficient space for living. Therefore, these types of basements have recently been made of reinforced concrete and in much larger sizes.

Reinforced concrete basements as described above are generally constructed, for example, by in-situ concrete deposition which is carried out by first performing excavation of the ground in an area broader than the size of the basement to be constructed. The excavation is performed to a predetermined depth by means of a power-shovel or the like to form a hollow area; gravel or the like is placed on the bottom of the hollow area, and then concrete is poured on the gravel bed to produce a concrete foundation. Then, reinforcing steel or other reinforcing material for the floor is arranged in a latticework, and concrete is deposited around the floor reinforcement. At this time, in order to allow connection of the floor reinforcements with the reinforcements for the side walls, the floor reinforcement is provided so that upright bars are arranged so as to protrude from the surface of the concrete at positions where side walls are to be vertically provided. After the concrete floor portion sets, the upright bars protruding at the predetermined positions of the floor are connected to vertical bars of the side walls, and then horizontal bars of the side walls are connected to the vertical bars to construct the reinforcements of the side walls. After this, forms are assembled on both sides of the thus-constructed reinforcements of the side walls, and concrete is deposited in the cavities defined by the forms to produce the side walls. After the hardening of the concrete in the side walls, the forms are disassembled, and space remaining between the outside of the side walls and the side of the excavation is filled, thereby completing the construction of the basement.

However, in the conventional techniques for the construction of basements, construction is performed by pouring concrete on-site, and as a result there arises various problems, for example, poor operational efficiency and prolonged construction period. In addition, construction operation involving concreting on-site has the problem that when constructing side walls, space for assembling frameworks must be provided on both sides of the side wall reinforcements, and this requires excavation over an area broader than the area the finished basements will occupy, resulting in increased cost.

Accordingly, the present inventors have conducted research to solve the above-described problems, and as a result they have found that when an entire basement is instead constructed by connecting precast concrete blocks, not only is the efficiency of operation on-site increased, but also the area of ground excavated may be decreased since the basement can be formed simply by setting or installing the blocks.

However, problems remain to be solved in that merely partitioning the inside of the basement into blocks when pouring concrete results in the size of the individual blocks to increase and thereby requires increased operation to connect blocks to one another.

When basements are made of precast concrete, particular care must be taken with respect to waterproofing, and a problem arises in that operations to ensure waterproofing decrease the efficiency of operation on-site.

SUMMARY OF THE INVENTION

The present invention was made in light of the above and it is therefore an object of this invention to provide a concrete prefabricated basement which is simple to construct and can be easily formed from precast concrete blocks, and which increases the efficiency of on-site operation; and it is a further object of this invention to provide a method for constructing such a basement.

Therefore, according to one aspect of this invention, there is provided a concrete prefabricated basement having a plurality of underground units, each of which includes a bottom plate portion having a generally rectangular shape and a side plate portion, to form a rectangular box-shaped structure with an open top, the plurality of underground units being arranged side by side in the direction of width of the underground units, and any adjacent two of the plurality of underground units being connected to each other, wherein the underground units each comprises a plurality of precast concrete blocks abutting one another at planes each perpendicular to a direction along the length of the underground units, the blocks being connected to one another by metal fastening elements, and wherein the blocks have a waterproof layer and a protective layer on the waterproof layer over the entire outer surface of the bottom plate portions and side plate portions of the blocks.

According to another aspect of this invention, there is provided a method of constructing a basement including a plurality of underground units; each of the underground units includes a bottom plate portion having a generally rectangular shape and a side plate portion to form a rectangular box-shaped structure with an open top, the bottom plate portion and side plate portion having on their outer surfaces a waterproof layer and a protective layer on the waterproof layer, said method comprising the steps of:

providing a main body block made of precast concrete and having a bottom plate portion and a set of opposing side plate portions integral with the bottom plate portion, with one pair of ends of the side plate portions being respectively connected to one set of opposing ends of the bottom plate portion to form a trough-like structure having a generally U-shaped cross-section, and a gable-wall block having a bottom plate portion and three side plate portions integral with the bottom plate portion, with one pair of ends of the side plates being respectively connected to one set of opposing ends and one of the other set of opposing ends of the bottom plate so as to surround the bottom plate portion with one of the four ends of the bottom plate portion being open;

providing a waterproof layer on the entire outer surfaces of the bottom plate portion and the side plate portions of the block constituting the basic basement structure;

providing a protective layer on an outer surface of the waterproof layer;

arranging two gable blocks and at least one main body block so that the gable blocks sandwich the at least one main body block;

arranging a plurality of the resulting underground units side by side in the direction of width of each underground unit;

setting the gable blocks and the at least one main body block to a foundation;

connecting the main body block to the gable block such that an open end of the bottom plate portion of the main body block and an open end of the bottom plate portion of the gable block abut one against another to form an underground unit having a bottom plate portion having a generally rectangular shape and a side plate portion to form a rectangular box-shaped structure with an open top; and connecting any adjacent two of the plurality of the underground units arranged side by side to each other with a metal fastener to integrate them to form a basic basement structure.

According to this invention, underground units can be constructed by providing a set of precast concrete blocks having shapes of parts of an underground unit divided as if it had been cut in planes perpendicular to a longitudinal axis of the underground unit, setting these blocks inside an excavated hole, and connecting the blocks to each other in a direction along the length of the underground unit, which facilitates on-site assembly of the underground units.

Furthermore, according to this invention, the bottom plate portions and side plate portions of the blocks are each provided with a waterproof layer over the entire outer surface thereof and a protective layer on the outer surface of the waterproof layer, resulting in simplified on-site waterproofing operations.

According to still another aspect of this invention, there is provided a dwelling construction with a basement, including a concrete prefabricated basement having a plurality of underground units, each of which includes a bottom plate portion having a generally rectangular shape and a side plate portion, to form a rectangular box-shaped structure with an open top, the plurality of underground units being arranged side by side in the direction of width of the underground units, and any adjacent two of the plurality of underground units being connected to each other;

a dwelling mounted on the basement; and at least one beam provided between the house and the basement;

wherein each of the underground units comprises a plurality of precast concrete blocks abutted one to another at planes parallel to each other and perpendicular to a direction along the length of the underground units, the blocks being integrated with each other by means of a first connecter.

DESCRIPTION OF PREFERRED EMBODIMENTS

Hereafter, this invention will be explained in greater detail by describing embodiments with reference to accompanying drawings.

Figure 1A:
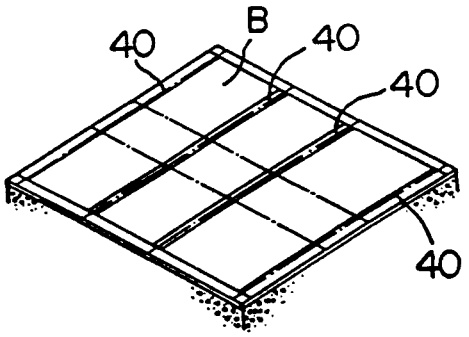
FIG. 1A to FIG. 1I are each a perspective view showing the method of constructing a basement according to one embodiment of this invention.
Figure 1B:
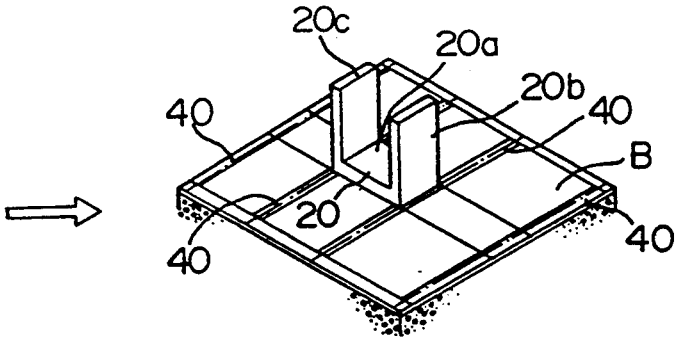
Figure 1C:
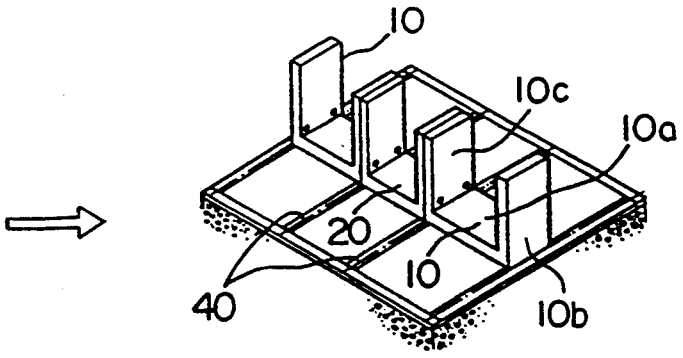
Figure 1D:
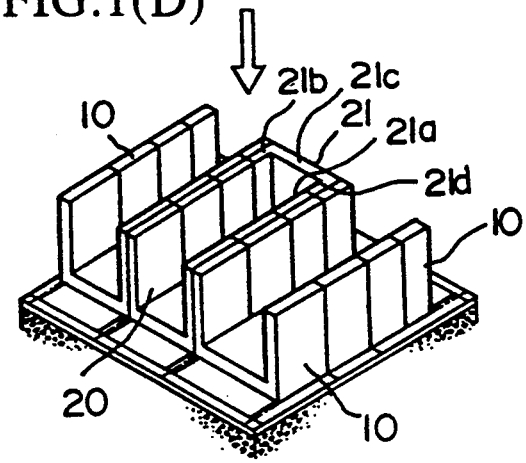
Figure 1E:
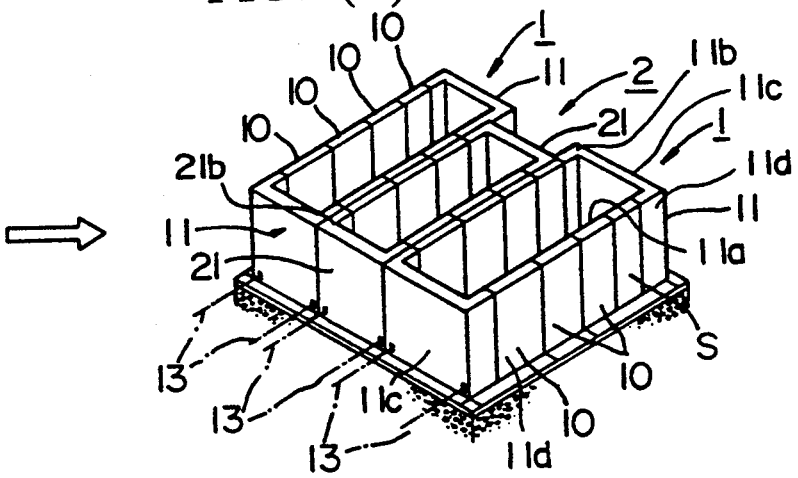
Figure 1F:
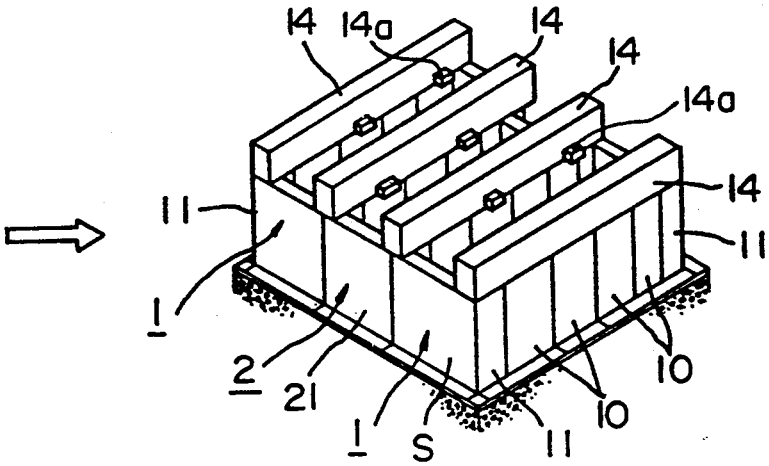
Figure 1G:
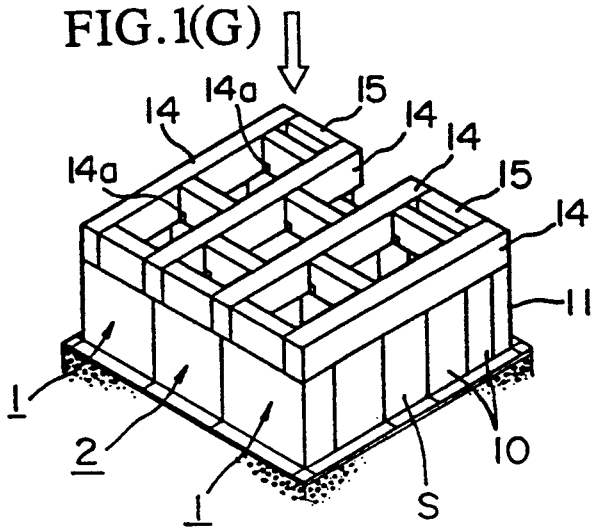
Figure 1H:
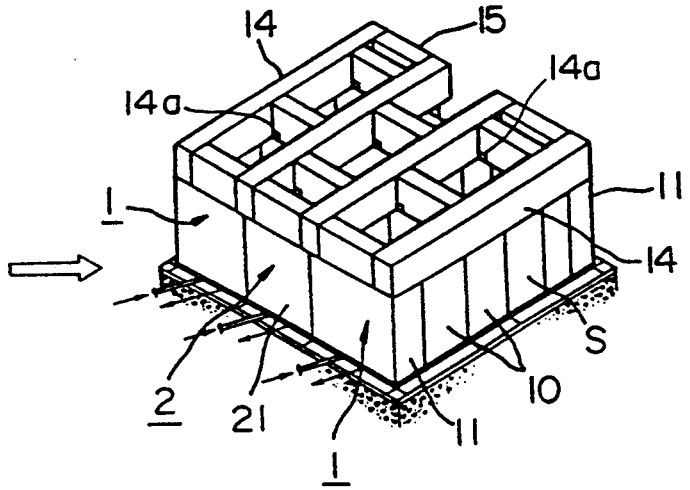
Figure 1I:
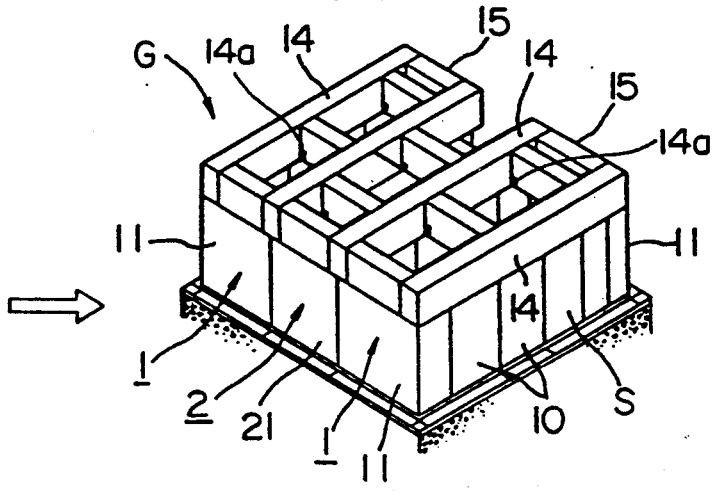
Figure 2:
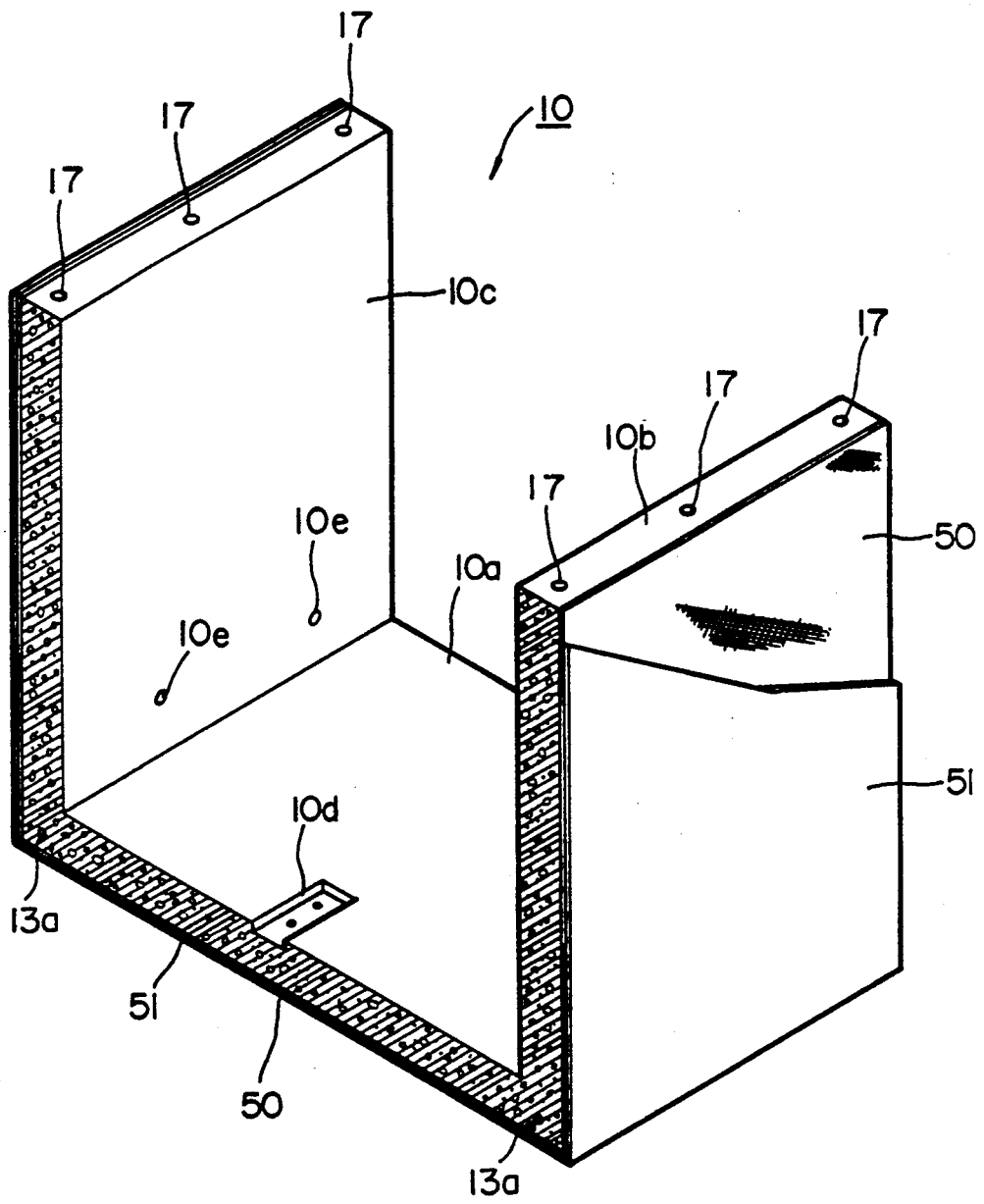
FIG. 2 is a perspective view of an example of the block used in the construction method of this invention.
Figure 3:
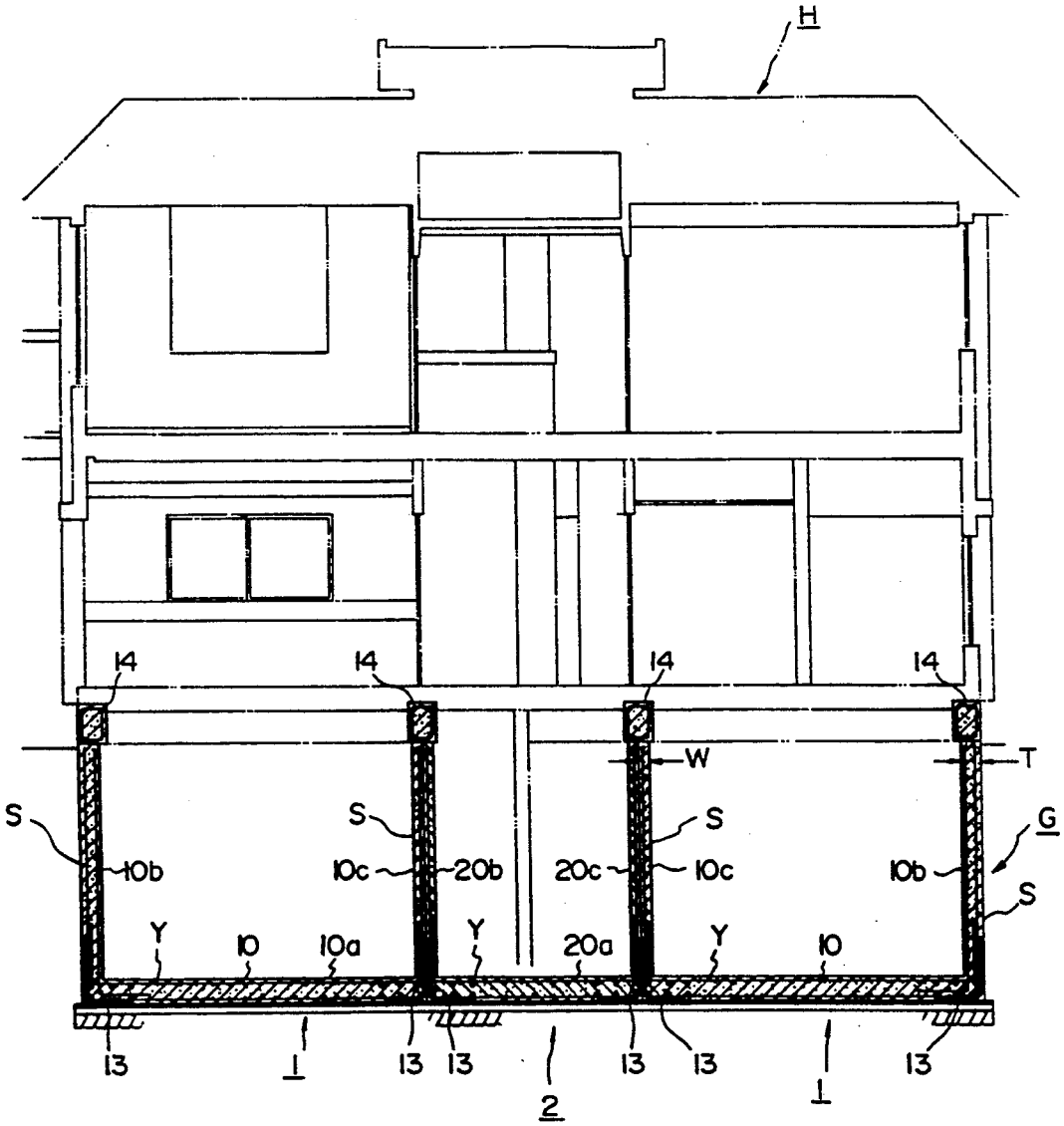
FIG. 3 is a cross-sectional view of the basement on which a house is placed.
Figure 4:
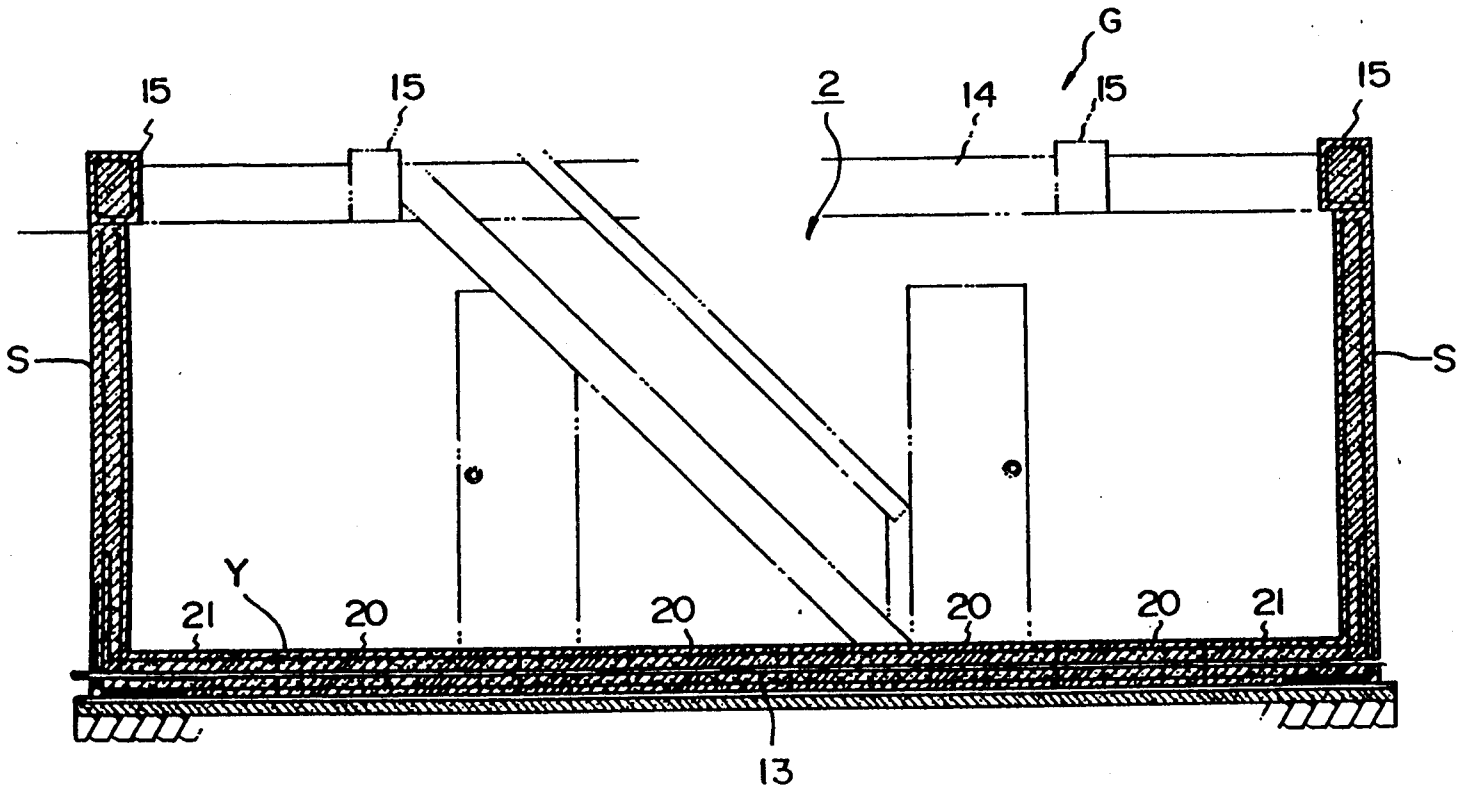
FIG. 4 is a cross-sectional side view of the basement shown in FIG. 3.
Figure 5:
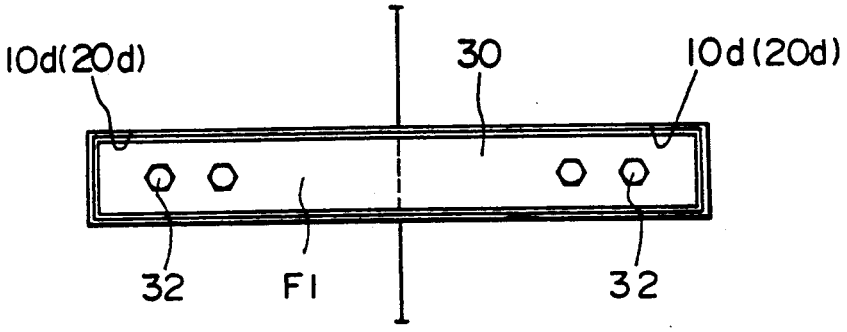
FIG. 5 is a plan view of a metal joint for connecting two adjacent underground units.
Figure 6:
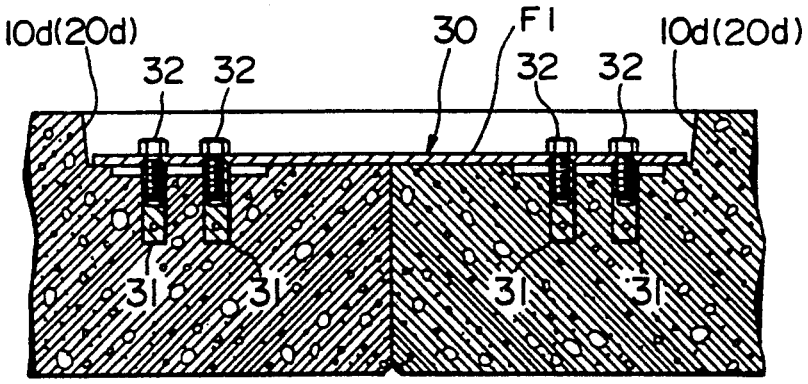
FIG. 6 is a cross-sectional view of the metal joint shown in FIG. 5.

FIGS. 1A to 1I illustrate the procedure of the construction of the prefabricated concrete basement according to one embodiment of this invention, and FIG. 2 shows an example of the block for constructing the basement used in the method of constructing such a basement. FIG. 3 is a cross-sectional view of the basement on which a house is placed.

First, the basic idea for practicing the method of constructing the basement according to this invention will be explained with reference to FIGS. 1A to 1I and FIGS. 2 and 3. One of problems which arises when basements are made of precast concrete is that merely partitioning the inside of the basement into blocks results in increased sizes of individual blocks and the presence of a variety of forms of blocks; this complicates on-site construction operations and complicates on-site waterproofing procedures.

In view of this, in this invention, the blocks used to construct the basement comprise a bottom plate portion and a side plate portion surrounding the bottom plate portion to form a rectangular box-type underground unit with an open top. There are two types of underground units, i.e., a first underground unit 1 and a second underground unit 2. In the embodiment illustrated in FIGS. 1A to 1I and FIG. 3, the first underground unit 1 is somewhat longer than the second underground unit 2. As shown in FIGS. 1F to 1I and in FIG. 3, the basement according to the present embodiment is composed of three underground units; more specifically, two first underground units and one second underground unit, the two first underground units sandwiching the second underground unit. Taking into consideration the transportability of blocks to the operation site (construction site) and the efficiency of operation or construction during the setting of the blocks, and in order to improve that transportability and operational efficiency, each of the first and second underground units 1 and 2 is composed of main body blocks 10 and 20 each having a U-shaped cross-section corresponding to an inner portion of the underground unit, and gable blocks 11 and 21 each of which constitutes an end portion of each of the underground units. The main body blocks and gable blocks together correspond to the underground unit cut in a plurality of planes parallel to each other and perpendicular to the direction along the length of the underground unit.

In order to facilitate the on-site operation of waterproofing, as shown in FIG. 2, a waterproof layer 50 may be provided over the entire outer surfaces of each of the bottom plate portions and side plate portions of the main body blocks 10 and 20 and over the entire outer surfaces of the gable blocks 11 and 21, and furthermore a protective layer 51 may be provided over the entire outer surface of each waterproof layer 50.

FIGS. 3 to 12 show a specific example of the basement of this invention constructed by the method illustrated in FIGS. 1A to 1I. In FIGS. 3 to 12, symbols G and H designate a basement and a house placed on the basement, respectively.

The above-described basement G has the following general construction. That is, two types of underground units 1 and 2, each of which is composed of a bottom plate portion Y and a side plate portion S surrounding the bottom plate portion Y, and each of which has a rectangular box shape with an open top, are arranged side by side in a lateral direction. In FIG. 1E, the underground unit 2 is shown sandwiched by two underground units 1. The underground units 1 and 2 (two underground units 1 and one underground unit 2) are connected to one another, with the respective side plate portions of the adjacent underground units being connected to each other by connection bolts penetrating the side plate portions and by metal fastening elements. Furthermore, the blocks constituting the underground unit 1 or 2 are connected to one another and integrated with PC steel bars (metal fastening elements) 13 which penetrate the blocks, or are inserted in insert holes 13*a* provided in the blocks longitudinally, that is, along the length of the underground unit to be constructed (cf. FIGS. 1E, 2 and 11). In the embodiment illustrated in the drawings, two types of beams, i.e., a longer beam 14 and a shorter beam 15, are placed on respective upper ends of the side plate portions of the main body blocks 10 and of the gable blocks 11 in order to connect the blocks to one another. As a result, the underground units 1 and 2 can also serve as a foundation for a building H such as a house or dwelling.

The underground unit 1 comprises a plurality of precast concrete blocks 10 and 11 divided in parallel planes perpendicular to a direction along the length of the underground unit 1, which are connected to one another by a joint material for preventing the penetration of water, by PC steel bars 13 penetrating the bottom plate portions of the blocks, and by the beams put on the upper ends of the blocks 10 and 11.

More specifically, the blocks 10 and 11 have been prefabricated in a factory in predetermined shapes and sizes as explained hereinbelow. The main body blocks 10 are designed to constitute inner or central portions of the underground unit 1, and the gable blocks 11 are designed to construct gable portions at both ends of the underground unit 1.

The main body blocks 10 and the gable blocks 11 are arranged such that the main body blocks are positioned in the center and are sandwiched by gable blocks 11; the end faces of any two adjacent blocks 10 and 11 are abutted one against another, and then the PC steel bars 13 are placed so as to penetrate the blocks through appropriate guide holes 13*a* provided therein and are tensed to introduce prestress into the blocks. This firmly connects the blocks to one another, thus forming the underground unit 1.

Each main body block 10 which constitutes inner or central portions of the underground unit 1 has a bottom plate section 10*a* and a pair of opposing side plate sections 10*b* and 10*c* to form a trough-like structure of U-shaped longitudinal cross-section as shown in FIG. 1C and FIG. 2. The bottom plate sections together constitute the bottom plate portion Y, and the side plate sections together form the side plate portion S. The outer surfaces of the bottom plate section 10*a* and side plate sections 10*b* and 10*c* of the main body block 10 are covered with a waterproof layer 50, and a protective layer 51 is provided on the waterproof layer 50. These layers prevent the penetration of natural ground water into the inside of the basement.

The waterproof layer 50 is preferably a waterproof sheet such as one made of rubber asphalt, vulcanized rubber, or polyvinyl chloride, which is bonded to the bottom plate sections or side plate sections. However, the waterproof layer 50 is not limited thereto and may be constructed by coating a waterproof material such as asphalt-based waterproof material on the wall surface of the basement.

The protective layer 51 protecting the waterproof layer 50 may be formed by applying plastic boards or the like on the waterproof layer 50. However, the protective layer 51 may be made of other materials or may be constructed in a manner other than described above as long as the waterproof layer 50 can thereby be prevented from being brought into direct contact with the surrounding earth.

The bottom plate section 10*a* of the main body block 10 is formed with a depressed portion 10*d* for receiving a metal connector 30 which is primarily composed of a single steel plate F1. In the depressed portion 10*d* are embedded a plurality of inserts 31 for being engaged with bolts 32 to fix the metal connector 30.

In contrast, with regard to the side plate sections 10*b* and 10*c*, the side plate section 10*c* on the side at which the underground unit 2 is connected, has a thickness W which is about ⅔ as large as the thickness T of the side plate section 10*b*; therefore, when the side plate sections 10*b* and 10*c* are joined, the total wall thickness of this overlapping portion does not become too large (cf. FIGS. 1C to 1E).

Figure 7:
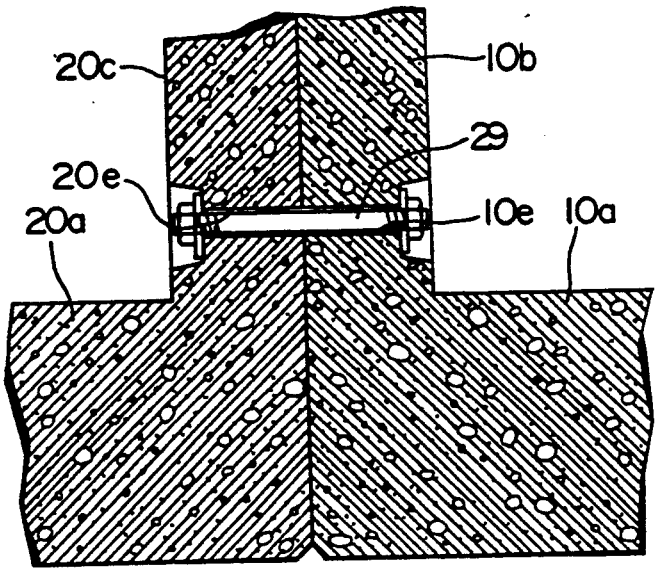
FIG. 7 is cross-sectional view of the connection structure connecting the side plate portions of the adjacent underground units to each other.
Figure 8:
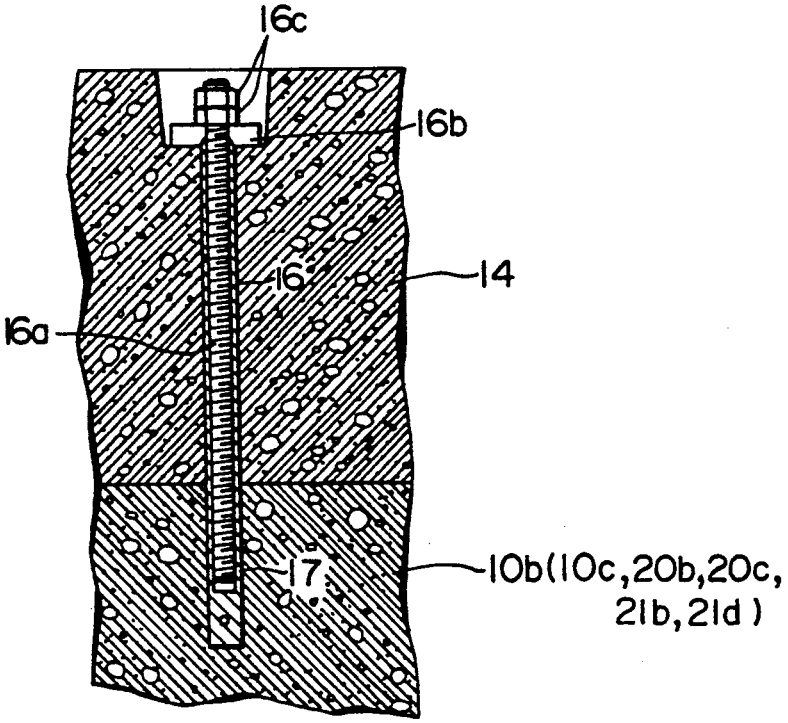
FIG. 8 is a cross-sectional view of the connection structure connecting the beam to the side plate portion of the underground unit.

If desired, each of the thinner side plate sections 10*b* and 10*c* may be provided with a plurality of insert holes 10*e* (cf. FIG. 2) through which may be inserted connection bolts 29 for connecting adjacent underground units as shown in FIG. 7. On the upper end of each of the side plate sections 10*b* and 10*c* may be formed a plurality of insert holes 17 through which may be screwed long bolts 16 for fixing beams 14 and 15 to the side plate section 10b or 10c, as shown in FIG. 8. In the embodiment as illustrated, the long bolts 16 are mainly composed of axles 16a formed as male screws, fixation plates 16b, and nuts 16c threadedly engaged with the axles 16a via the fixation plates 16b.

Figure 9:
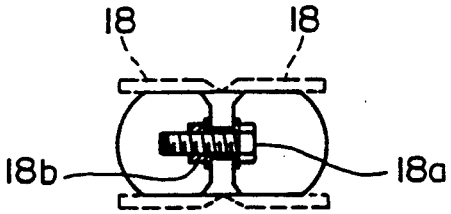
FIG. 9 is a plan view of the metal joint fitting for connecting the blocks to each other.

If desired, the side plate section 10b may be provided with a metal joint 18 having a generally U-shaped cross-section as shown in FIG. 9, for example. The metal joints 18 provided in the two adjacent side plate sections 10b can be fastened with each other by a bolt 18a and a nut 18b.

Figure 11:
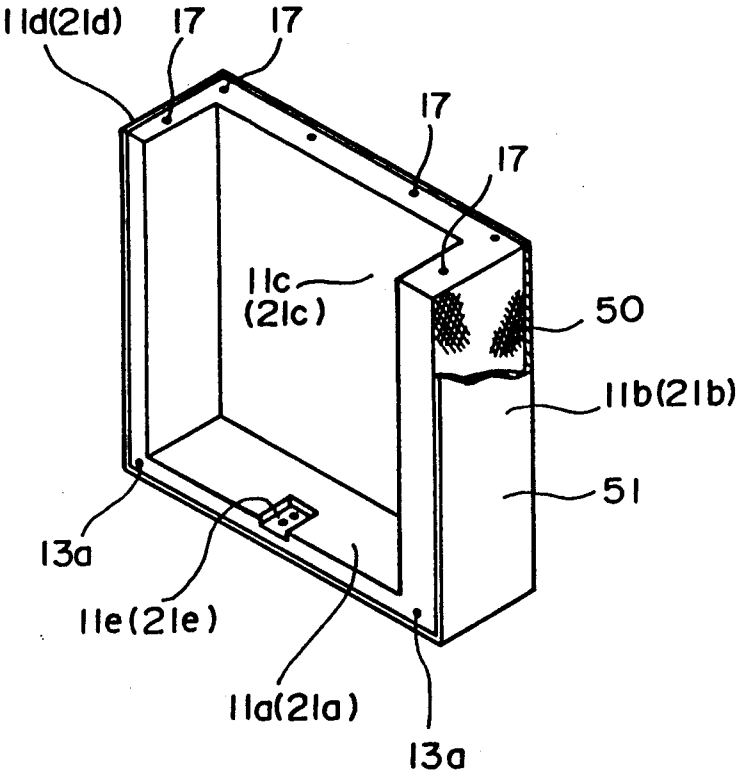
FIG. 11 is a perspective view of the block constituting the gable portion of the underground unit.

On the other hand, the gable block 11 which constitutes each end of the underground unit 1 comprises a bottom plate section 11a having a rectangular shape, and side plate sections 11b, 11c, and 11d surrounding three end faces of the bottom plate section 11a, as shown in FIG. 11. In this embodiment, the side plate section 11c constitutes the gable wall of the underground unit 1.

In the case of the gable block 11, as in the case of the inner block 10, the waterproof layer 50 is provided over the entire outer surface of each of the bottom plate sections 11a and the side plate sections 11b, and the protective layer 51 is provided on the entire outer surface of each waterproof layer 50. The bottom plate section 11a is provided with a plurality of depressed portions 11e in each of which is embedded an insert 17 for screwing therein a long bolt 16. The side plate section 11d of the block 11 on the side at which the underground unit 2 is connected has a thickness W which is about ⅔ as large as the thickness T of the side plate section 11b, so that when the side plate sections 11b and 11d are overlapped, the total wall thickness of this overlapped portion does not become too large (cf. FIG. 1E). On the upper end of each of the side plate sections 11b, 11c, and 11d may be formed a plurality of inserts 17 having the same structure as those shown in FIG. 8, each of the inserts 17 being for screwing therein a long bolt 16 for fixing the beams 14 or 15 to the side plate section 11b, 11c, or 11d, in a manner similar to the case where the beams 14 or 15 are connected to the side plate sections 10b or 10c with inserts 17, as shown in FIG. 8.

Next, explanation will be given of the structure of the underground unit 2 to be sandwiched by two individual underground units 1.

Basically, the underground unit 2, like the above-described underground unit 1, is composed of a plurality of precast concrete blocks (i.e., main body blocks 20 and gable blocks 21) divided in parallel planes perpendicular to a direction along the length of the underground unit 2, which are connected to each other by a joint material for preventing the penetration of water, by PC steel bars 13 penetrating the bottom plate portions of the blocks, and by two kinds of beams, i.e., longer beam 14 and shorter beam 15 placed on the upper ends of the blocks 20 and 21.

The blocks 20, one of the components of the underground unit 2, each comprise a bottom plate section 20a and a pair of opposing side plate sections 20b and 20c and are formed in a generally U-shaped cross-section while the gable blocks 21, another component of the underground unit 2 to be positioned at both ends of the underground unit 2, each comprise a bottom plate section 21a and side plate sections 21b, 21c, and 21d surrounding three end faces of the bottom plate section 21a and have a generally U-shaped cross-section. As for the blocks 20 and 21, the waterproof layer 50 is provided over the entire outer surface of each of the bottom plate sections 20a and 21a, and side plate sections 20b, 20c, 21b, 21c and 21d, and furthermore a protective layer 51 is provided over the entire outer surface of each waterproof layer 50.

However, because the underground unit 2 is to be arranged so that it is sandwiched by two of the underground units 1, the side plate sections 20b and 20c of the main body block 20 constituting inner or central portions of the underground unit 2 and the side plate sections 21b and 21d of the gable block 21 constituting the gable portions of the underground unit 2 each have a thickness W which is about ⅔ as large as the thickness T of the side plate section 10b constituting the outer wall of the main block 10 so that when the side plate sections of two adjacent underground units are overlapped, the total wall thickness of this overlapped portion does not become too large (cf. FIGS. 1C through 1E).

Figure 10:
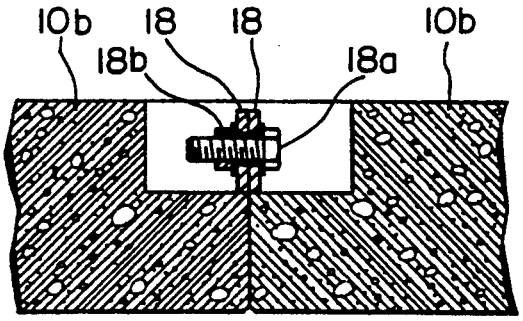
FIG. 10 is a cross-sectional view of the metal joint fitting shown in FIG. 9.

The main body blocks 20 and gable blocks 21 have structures similar to that of the blocks 10 and 11 in other respects. That is, on the upper end of each of the side plate sections 20b, 20c, 21b, and 21d may be formed a plurality of insert holes 17 each for screwing therein the long bolt 16 for fixing beam 14 and 15 to the side plate sections 20b, 20c, 21b, or 21d as shown in FIG. 8. If desired, the side plate section 20b, 20c, 21b, or 21d may be provided with the metal joint 18 which may be the same as the one used for connecting the two adjacent side block sections 10b and 10b as shown in FIGS. 9 and 10. The metal joints 18 provided in the two adjacent side plate sections 20 and 20c or the like can be fastened to one another with the bolt 18a and the nut 18b. Each of the side plate sections 20b, 20c, 21b and 21d may be provided with a plurality of insert holes 20e similar to the insert holes 10e shown in FIG. 2, each for inserting therein the connection bolt 29 for connecting adjacent underground units, as is shown in FIG. 7.

Explanation will be given of the two types of beams, i.e., the longer beams 14 and the shorter beams 15 to be placed on the blocks 10, 11, 20, and 21. The beams 14 and 15 are each made of precast concrete in the form of a square column, and these beams fix the upper ends of the blocks 10, 11, 20, and 21 connected to each other longitudinally, as well as support first floor panels of the overlying construction (for example, a dwelling, in the illustrated embodiment; cf. FIG. 3). The longer beams 14 are firmly fixed to the side plate portions of the underground unit 1 along the length thereof through a plurality of long bolts 16 penetrating the beams 14 vertically (cf. FIG. 8).

Figure 12:
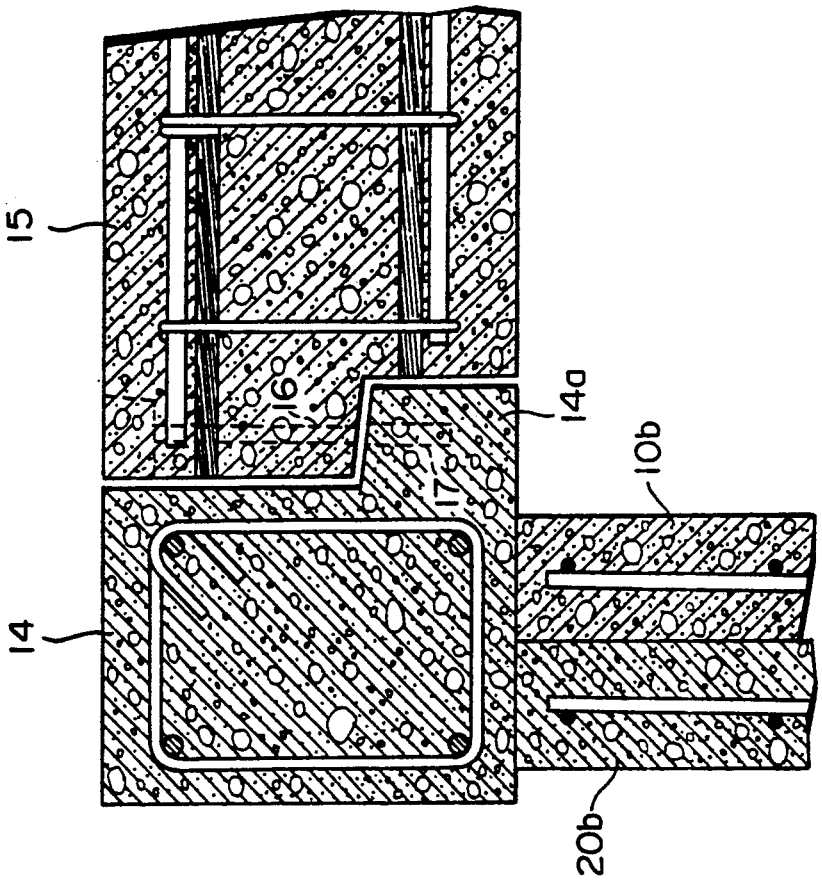
FIG. 12 is a cross-sectional view of the structure of the connection portion of the beam.

As shown in FIG. 12, each longer beam 14 has a mount portion 14a integrally formed on one side and protruding therefrom on a lower portion thereof. The mount portion 14a, which is provided with inserts 17 similar to the inserts 17 provided in the blocks 10 or the like as shown in FIG. 8, is useful for mounting one of the shorter beams 15. The shorter beams 15 can be fixed to the mount portions 14a of the longer beams 14 by screwing the long bolts 16 penetrating the shorter beams 15 into the respective inserts 17 provided in the mount portions 14a substantially in the same manner as in the case of the connection of the longer beams 14 to the blocks 10 or the like, as shown in FIG. 8.

While the shorter beams 15 are made of precast concrete in the present embodiment, they may also be made of I-beam steel.

The house or dwelling H which is constructed on the underground units 1 and 2 may be one which comprises united floor panels placed on the beams 14, first floor wall panels and second floor panels on the united floor panels, frameworks, wooden works, and roof panels. The house H is not limited particularly to the above-described one but may also be of other conventional construction methods or of conventional prefabricated construction.

The house can be connected to the beams, for example, through anchor bolts provided in and protruding from upper surfaces of the beams so that the wall panels, floor panels and the like can be unified.

Next, explanation will be given of a method to construct a basement using the underground units described above and also for a method to construct a dwelling with such a basement.

First, precast concrete blocks constituting the underground units 1 and 2 are prefabricated by integrally setting concrete or the like in a factory to have a predetermined size. The waterproof layer 50 is provided over the entire outer surface of each block and the protective layer 51 is provided in the factory over the entire surface of the waterproof layer 50.

Since the blocks are formed in a generally U-shape in cross-section, divided in parallel planes perpendicular to a direction along the length of the underground unit 1 or 2, it is necessary to prepare only two types of blocks, i.e., U-shaped blocks constituting inner or central portions of the underground unit 1 or 2, and blocks constituting gable portions of the underground unit 1 or 2. When the construction of a large basement is desired, it is unnecessary to increase the dimensions of each block; it is sufficient to use a larger number of U-shaped blocks. This improves the transportation efficiency of the blocks from the factory to the construction site considerably. The blocks thus obtained are then transported to a construction site.

Before constructing a basement by assembling the blocks on-site, a suitable area of the ground is excavated to form a hole of a predetermined size; a crushed stone foundation is formed, and a concrete slab is poured on the crushed stone foundation, thereby completing the foundation. Furthermore, at this time, steel pipes 40, serving as a standard for the level of installing the blocks, are embedded (cf. FIG. 1A).

Then, the blocks are lifted from the vehicle in which they were transported by means of a crane and are brought down to the ground and assembled on-site by connecting them with each other in the order shown in FIGS. 1A to 1E.

More specifically, first installation is initiated in the center of the arrangement as shown in FIG. 1B (that is, the central portion of the underground unit 2, i.e., the block 20, is installed first in the present embodiment illustrated), and two blocks 10 are connected to both sides of the block 20, as shown in FIG. 1C. When the blocks 10 are connected to the block 20, the long bolts 29 are inserted in the insertion holes formed in the blocks 10 and the block 20 so that the blocks 10 and the block 20 can be integrally assembled (cf. FIG. 7).

Thereafter, another block 20 is connected to the first-installed block 20 in a longitudinal direction or in the direction of the length of the underground unit 2 to be constructed. At this time, the metal connector 30 is placed over the two depressed portions **20*d* of the two adjacent blocks 20 and the metal connector 30 is fixed to the blocks 20 through the bolts 32 threadedly engaged with the inserts 31 embedded in the blocks 20 so that the adjacent blocks 20 can be integrally assembled. Whenever a new block 20 is connected to the immediately preceding block 20, one block 10 is connected to each side of the new block 20 in the same manner as described above, and this procedure is repeated until a predetermined number of the blocks 10 and 20 constituting the inner or central portion of the underground units 1 and 2 are installed. Finally, gable blocks 11 and 21 constituting the gable portions of the underground units 1 and 2 are installed. The gable blocks 11 and 21 are assembled with adjacent blocks 10 and 20, respectively, by placing the metal connector 30 over the depressed portions 10*d* and 11*e* or over the depressed portions 20*d* and 21*e* and fixing the metal connector 30 to the block 10 or 20 through the bolts 32 threadedly engaged with the inserts 31 embedded in the blocks 10 and 11 or blocks 20 and 21. The PC steel bars 13** are inserted through the respective sheath holes provided in the blocks longitudinally, and the bars are stressed using a jack and fixed at their both ends to give prestress to the structure (cf. FIG. 1E). After giving stress to the PC steel bars, grout is filled into the sheath holes or pipes.

After giving stress to the PC steel bars, the longer beams 14 are fitted on the upper ends of the side plate sections of the underground units as shown in FIG. 1F, and then the shorter beams 15 are assembled with the longer beams 14 so that the shorter beams 15 are supported on the mounts **14*a* of the longer beams 14** as shown in FIG. 1G. Thus, the skeleton of the basement is completed.

Upon completion of the stressing of the PC steel bars and of the fitting of the beams 14 and 15, grout such as cement paste, mortar, bentonite water or other material is poured between the bottom plate sections of the blocks and the foundation concrete, as shown in FIG. 1H, to fill the cavity therebetween with the grout so that the side plate sections can adhere firmly to the foundation.

After completion of final interior finishing works and the like, the basement as shown in FIG. 1I is completed.

The above-described house H is constructed, for example, by putting united floor panels on the beams 14 and 15, assembling first floor wall panels and second floor wall panels on the united floor panels, forming frameworks and wooden works, and assembling roof panels if the house is to be constructed primarily of panels.

Each wall panel of the first floor portion of the house H may be integrally connected to the basement by fitting the anchor bolts protruding from the upper faces of the beams made of concrete into holes provided at a lower end of each wall panel and connecting the basement and the wall panels by bolts.

Figure 13:
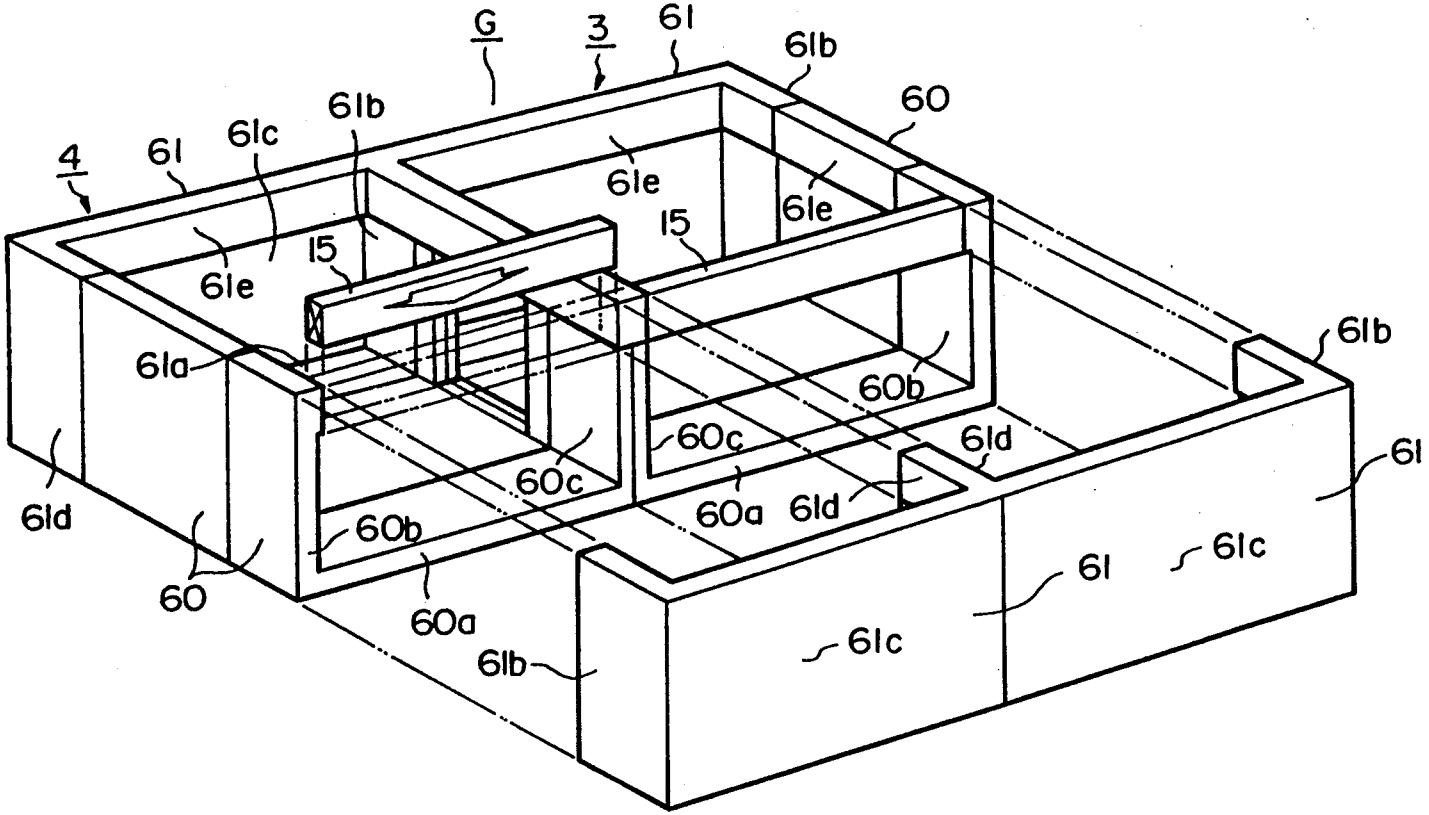
FIG. 13 is a schematic perspective view of the basement according to another embodiment of this invention.

FIG. 13 shows another embodiment of this invention, in which the basement G has a skeleton which comprises two underground units 3 and 4 connected to each other side by side in a width direction. The underground units 3 and 4 are each composed primarily of a plurality of precast concrete blocks, i.e., main body block 60 and gable block 61, divided in parallel planes perpendicular to a direction along the length of the underground unit 3 or 4. The block 60 comprises a bottom plate section **60*a* and side plate sections 60*b* and 60*c*, while the block 61 comprises a bottom plate section 61*a* and side plate sections 61*b*, 61*c*, and 61*d*. The side sections 60*b* or 61*d*** to be connected to the side plate section of the adjacent underground unit has a thickness about ⅔ that of the other side plate section, or the side plate section constituting the outer wall of the skeleton.

Thus, the construction of the blocks 60 and 61 is substantially the same as that of the blocks 10 and 11 or blocks 20 and 21 except that the blocks 60 and 61 have a beam portion 61*e*, which is integrally formed on an upper portion of each of the side plate sections 60*b*, 60*c*, 61*b*, 61*c* and 61*d*, and which serve as a beam. In other words, the beams 14 are integral with the side plate sections in this embodiment. As a result, it is no longer necessary to connect the beams 14 to the side plate sections by the structure as shown in FIG. 8, so that the step of assembling beams can be omitted. This further increases the efficiency of construction on-site.

By the above-described construction and procedures, installation of the blocks can be initiated beginning with the center of the arrangement and extending outwardly of the first-installed block, which enables precise installation and connection of blocks. More particularly, because the connection of blocks is performed using as a standard the main body block positioned in the center of a basement to be constructed, no block deviates from the standard main body block as first installed, and thus deviation from the standard block with respect to the positioning of other blocks, if any, can be minimized, resulting in precise connection.

Furthermore, the use of underground units including a plurality of precast concrete blocks of which adjacent blocks are connected through metal connectors 30 facilitates connection of the blocks in both longitudinal and lateral directions, making it possible to easily construct and assemble the underground units on-site.

The provision of the waterproof layer 50 and the protective layer 51 over the entire outer surface of each of the bottom plate sections and side plate sections of the block can simplify the waterproofing work on-site.

Reduction of the thickness of the side plate section to be connected to an adjacent side plate section to a thickness of about $\frac{2}{3}$ of the thickness of the side plate section constituting the outer wall of the basement enables efficient utilization of materials, without increasing the thickness of the partitioning wall inside thereof even when the underground units are connected side by side in a lateral direction.

Integration of the blocks of adjacent underground units with bolts penetrating through the side plate sections thereof not only avoids differences in level between or among the underground units but also increases the mechanical strength of the structure.

Because the house H can be assembled on the basement by utilizing the beams or beam portions of the basement as a foundation, the construction of a foundation which is conventionally unavoidable, can be omitted. This makes it possible to construct a basement without limitations on the position of the foundation, enabling the construction of large basements.

This invention is not limited to the above-described embodiments, and may, for example, have the sizes and shapes of the blocks varied appropriately depending on design considerations and the like. For example, blocks constituting an entrance portion of the underground unit or room may be formed with an opening portion as required. At this time, the underground room units can be integrated with each other by connecting the bottom plate section of one of the two adjacent underground units to the bottom plate sections of other units.

What is claimed is:

1. A concrete prefabricated basement having a plurality of underground units, each of said underground units forming a rectangular box-shaped structure with an open top, each of said underground units comprises a plurality of precast concrete blocks abutted one to another at parallel planes perpendicular to the direction along the longitudinal direction of the underground units, the blocks being integrated with each other by a first connection means and wherein said precast concrete blocks comprising at least one main body block having a first bottom plate section and two opposing first side plate sections integrally formed with said first bottom plate section so as to sandwich said first bottom plate section therebetween, said first bottom plate section and said two first side plate sections defining a U-shaped perpendicular cross-section, and at least two gable blocks having a second bottom plate section and three second side plate sections integrally formed with said second bottom plate section, with two of said second side plate sections opposing one another, and the remaining second side plate section being in contact a three end faces thereof with said two opposing second side plate section and said second bottom plate section of the main body block and said three second side plate sections of the gable block defining the rectangular box-shaped structure with an open top face;

each of said blocks having a previously formed waterproof layer and protective layer, said protective layer lying on said waterproof layer, over the entire outer surface of the bottom plate portion and the side plate portions of the blocks; and said underground units being arranged side by side in the lateral direction of the underground units, with any adjacent two of said plurality of underground units being connected to each other.

2. A concrete prefabricated basement as claimed in claim 1, further comprising a first beam on an upper end of each of said first plate sections and said second plate sections and a second beam supported by said first beam.

3. A concrete prefabricated basement as claimed in claim 2, wherein said first and second beams are precast concrete beams mounted on said upper end of each of said first plate sections and said second plate sections.

4. A concrete prefabricated basement as claimed in claim 3, wherein said first beam has at least one mount portion and is fixedly connected to said upper end of each of said first plate sections and said second plate sections by a bolt vertically penetrating said first beam, and said second beam is fixedly connected to said first beam with one end of said second beam being supported on one of said at least one mount portion of one of said first beam and the other end of said second beam being supported on one of said at least one mount portion of another adjacent first beam.

5. A concrete prefabricated basement as claimed in claim 4, wherein said first beam is a beam portion integrally formed on said upper end of each of said first plate sections and said second plate sections.

6. A concrete prefabricated basement as claimed in claim 1, wherein at least one of said two first side sections of said at least one main body block which is adjacent to another said first plate section or second plate section constituting an outer wall of said basement has a thickness approximately $\frac{2}{3}$ as large as a thickness of said first plate sections or said second plate sections constituting said outer wall of said basement.

7. A concrete prefabricated basement as claimed in claim 1, wherein any adjacent two of said first plate sections and said second plate sections of said at least one main body block and said gable blocks are connected to each other through a second connection means.

8. A concrete prefabricated basement as claimed in claim 1, wherein any adjacent two of said at least one main body block and said at least two gable blocks are connected to each other through a third connection means provided on each of said bottom plate sections of said adjacent two of said at least one main body block and said at least two gable blocks.

9. A concrete prefabricated basement as claimed in claims 1 or 7, wherein said first connection means comprises a bolt and a nut.

10. A concrete prefabricated basement as claimed in claim 7, wherein said second connection means is a PC steel bar.

11. A concrete prefabricated basement as claimed in claim 8, wherein said second connection means is a metal connector.

12. A house construction having a basement, including a concrete prefabricated basement having a plurality of underground units, each of said underground units forming a generally rectangular box-shaped structure with an open top, the plurality of underground units being arranged side by side in a lateral direction of the underground units, with any adjacent two of the plurality of underground units being connected to each other;

a dwelling mounted on the basement, with at least one beam provided between the dwelling and the basement;

the improvement wherein each of the underground units comprises a plurality of precast concrete blocks abutted one to the other at parallel planes perpendicular to the longitudinal direction of the underground units, the blocks being integrated with each other by said first connection means;

said precast concrete blocks comprising a least one main body block having a first bottom plate section and two opposing first side plate sections integrally formed with said first bottom plate section so as to sandwich said first bottom plate section therebetween, said first bottom plate section and said two first side plate sections defining a U-shaped perpendicular cross-section, and at least two gable blocks having a second bottom plate section and three second side plate sections integrally formed with said second bottom plate section, with two of said second side plate sections opposing one another, and the remaining second side plate section being in contact at three end faces thereof with said two opposing second side plate section and said second bottom plate section, said section bottom plate section of the main body block and three second side plate sections of the gable block defining the rectangular box-shaped structure with an open to face; and each of said blocks having a previously formed waterproof layer and protective layer, said protective layer lying on said waterproof layer, over the entire outer surface of the bottom plates portion and the side portion of the blocks.

13. A house construction as claimed in claim 12, further comprising a first beam on an upper end of each of said first plate sections and said second plate sections and a second beam supported by said first beam.

14. A house construction as claimed in claim 13, wherein said first beams and said second beams are each a precast concrete beam mounted on said upper end of each of said first plate sections and said second plate sections.

15. A house construction as claimed in claim 14, wherein said first beam has at least one mount portion and is fixedly connected to said upper end of each of said first plate sections and said second plate sections by bolts vertically penetrating said first beam, and said second beam is fixedly connected to said first beam with one end of said second beam being supported on one of said at least one mount portion of one first beam and the other end of said second beam being supported on one of said at least one mount portion of another adjacent first beam.

16. A house construction as claimed in claim 15, wherein said first beam is a beam portion integrally formed on said upper end of each of said first plate sections and said second plate sections.

17. A house construction as claimed in claim 12, wherein at least one of said two first side sections of said at least one main body block which is adjacent to another of said first plate sections or said second plate sections constituting an outer wall of said basement has a thickness approximately ⅔ as large as the thickness of said first plate sections or second plate sections constituting said outer wall of said basement.

18. A house construction as claimed in claim 12, wherein any adjacent two of said first plate sections and said second plate sections of said at least one main body block and said gable blocks are connected to each other through second connection means.

19. A house construction as claimed in claim 12, wherein any adjacent two of said at least one main body block and said at least two gable blocks are connected to each other through third connection means provided on each of said bottom plate sections of said adjacent two of said at least one main body block and said at least two gable blocks.

20. A house construction as claimed in claims 12, wherein said first connection means comprises a bolt and a nut.

21. A house construction as claimed in claims 12, wherein said first connection means comprises a bolt and a nut.

22. A house construction as claimed in claim 12, wherein said second connection means is a PC steel bar.

23. A house construction as claimed in claim 13, wherein said second connection means is a metal connector.

24. A method of constructing a basement including a plurality of underground units, each of which includes a bottom plate portion having a generally rectangular shape and a side plate portion to form a rectangular box-shaped structure with an open top, the bottom plate portion and side plate portion having on their outer surfaces a waterproof layer and a protective layer on the waterproof layer, said method comprising the steps of:

providing a main body block made of precast concrete and having a bottom plate portion and a set of opposing side plate portions integral with the bottom plate portion, with one ends of the side plate portions, respectively, being connected to one set of opposing ends of the bottom plate portion to form a trough-like structure having a generally U-shaped cross-section, and a gable-wall block having a bottom plate portion and three side plate portions integral with the bottom plate portion, with one ends of the side plates, respectively, being connected to one set of opposing ends and one of the other set of opposing ends of the bottom plate so as to surround the bottom plate portion with one of the four ends of the open bottom plate portion;

providing a waterproof layer on the entire outer surfaces of the bottom plate portion and side plate portions of the block which is to constitute the basic basement structural unit;

providing a protective layer on an outer surface of the waterproof layer;

arranging two gable blocks and at least one main body block so that the gable blocks sandwich the at least one main body block;

arranging a plurality of the resulting underground units side by side in a lateral direction of each underground unit;

setting the gable blocks and the at least one main body block on a foundation;

connecting the main body block the gable block such that an open end of the bottom plate portion of the main body block and an open end of the bottom plate portion of the gable block abut one against another to form an underground unit having a bottom plate portion having a generally rectangular shape and a side plate portion to form a rectangular box-shaped structure with an open top; and connecting any adjacent two of the plurality of the underground units arranged side by side to each other with a metal fastener to integrate them to form a basic basement structure.

* * * * *